US006108833A

United States Patent [19]

Grossman et al.

[11] Patent Number: 6,108,833

[45] Date of Patent: Aug. 29, 2000

[54] BI-FOLD FUTON FRAME INCLUDING FORCE SPREADING MORTISE PLATES

[75] Inventors: Joel Grossman, Selangor Darul Ehsan, Malaysia; Justin A. Kumar, San Jose, Calif.

[73] Assignee: Elite Furniture, Inc., San Jose, Calif.

[21] Appl. No.: 08/874,617

[22] Filed: Jun. 13, 1997

[51] Int. Cl.[7] ..... A47C 17/04

[52] U.S. Cl. ..... 5/37.1; 5/12.1; 5/47

[58] Field of Search ..... 5/12.1, 37.1, 41, 5/42, 39, 48, 203, 282.1, 285, 286, 288, 305, 279.1; 403/260, 258, 256

[56] References Cited

U.S. PATENT DOCUMENTS

| | | | |
|---|---|---|---|
| 65,970 | 6/1867 | Wardwell . | |
| 832,133 | 10/1906 | Lanz . | |
| 1,245,537 | 11/1917 | Van Fleet et al. . | |
| 1,955,909 | 4/1934 | Favreau | 5/288 |
| 2,983,931 | 5/1961 | Nelson | 5/305 |
| 4,068,332 | 1/1978 | Ball et al. | 5/296 |
| 4,223,866 | 9/1980 | Black . | |
| 4,280,269 | 7/1981 | Marini | 403/260 |
| 4,674,141 | 6/1987 | Hyatt et al. | 403/260 |
| 5,153,952 | 10/1992 | Barton et al. | 5/37.1 |
| 5,280,656 | 1/1994 | Gossett | 5/2.1 |
| 5,303,432 | 4/1994 | Fitts | 5/37.1 |
| 5,345,626 | 9/1994 | Newton | 5/37.1 |
| 5,438,811 | 8/1995 | Goya | 52/702 |
| 5,664,268 | 9/1997 | Stoler et al. | 5/47 |

*Primary Examiner*—Terry Lee Melius
*Assistant Examiner*—Fredrick Conley
*Attorney, Agent, or Firm*—Skjerven, Morrill, MacPherson, Franklin & Friel, L.L.P.; Kenneth C. Brooks

[57] ABSTRACT

A bi-fold futon frame includes force spreading mortise plates positioned at a junction between various wooden members. The mortise plates and the wooden memebers are held together by fasteners such as screws. The wooden members form the frame of the futon.

20 Claims, 7 Drawing Sheets

BI-FOLD FUTON FRAME INCLUDING FORCE SPREADING MORTISE PLATES

TECHNICAL FIELD

The present invention pertains to folding furniture. Specifically, the present invention pertains to wooden futons that may be selectively positioned to function as a couch and a bed.

BACKGROUND ART

Recently, the demand for foldable futons has increased due to the flexibility of use in that these futons may function as either a sofa or a bed. The dual functionality of the foldable futons makes them both cost effective and space saving. Foldable futons abrogate the need to have a separate sofa and bed. To further decrease the cost of foldable futons, many are manufactured with easily workable and inexpensive materials. In this fashion, futons may be manufactured without the need for highly skilled labor. This further reduces the cost of futons, because they may be manufactured in under-developed countries in which the workers earn a lower annual wage than workers in more developed countries.

Currently, foldable futon frames are available in a variety of designs. For example, U.S. Pat. No. 5,303,432 to Fitts discloses a convertible futon frame that includes opposed end frames interconnected by front and back rails to define a rigid rectangular frame. Seat and back members are movably connected to the rectangular frame and to each other so that an individual can convert the frame between sitting and sleeping positions.

Typically, foldable futon frames are made from either metal or wood. Metal futon frames are typically more durable than wooden futon frames. On the other hand, wooden futon frames are often more appealing, aesthetically, than metal futon frames. However, wooden futon frames suffer another drawback in addition to reduced durability, when compared to metal frames.

As discussed above, foldable futon frames are often produced in under-developed countries resulting in the futons having to be transported over large distances. During transportation, foldable futons are often stacked several high. A foldable futon located near the bottom of a stack maybe subjected to several thousands pounds of weight. This produces cracks and splits in the wooden planks that form the wooden futon frames, as well as bending in the rails that form the metal futon frames. The failure rate, however, of wooden futon frames, due to transportation, often far exceeds the failure rate of metal futon frames. This often reduces the savings benefit derived from transporting the lighter wooden futon frames.

What is needed, therefore, is a foldable futon that is formed from wood and provides strength and durability comparable to a metal futon frame.

SUMMARY OF THE INVENTION

A bi-fold wooden futon frame features a force spreading mortise plate positioned at a junction between the various wooden members, which are held together by fasteners such as screws, that form the futon frame. The present invention is based upon the discovery that cracks and splits which manifest in the wooden members during shipment, and/or repeated use of the futon frame, result from the relatively small coupling area of the fasteners. This results in a high force per unit area being applied to the wooden members causing premature fatigue in the same. To overcome this problem, a force spreading mortise plate is positioned proximate to at least one of the junctions to reduce the force per unit area to which the wooden members are subjected. The force spreading mortise plate includes a mortise member and a hook member extending transverse to the mortise member. The mortise member is disposed proximate to a junction, between a pair of the wooden members, and the hook member extends adjacent to one of the pair. A first plurality of fasteners extend through the pair of wooden members so as to pass through the mortise member. A second plurality of fasteners extend through the hook member and into one of the pair of wooden members. In this fashion, forces exerted upon both the first and second plurality of fasteners are distributed between the mortise member and the hook member, thereby reducing the force per unit area on each of the pair of wooden members.

In the preferred embodiment, the futon frame includes a pair of spaced-apart legs, a pair of spaced-apart and parallel cross-members, extending between the legs, a seat platform and a back platform pivotally coupled to the seat platform. The back and seat platforms each includes a pair of spaced-apart and parallel side-planks, a pair of spaced-apart and parallel front-planks and a panel-board, or slat, extending between the pair front-planks. The pair of front-planks extend from opposite ends of one of the parallel side-planks, transverse thereto, terminating at opposite ends of the remaining side-plank of the pair. In this manner, a plurality of junctions are formed between the pair of side-planks and the pair of front-planks. The force spreading mortise plate is positioned at each of the plurality of junctions. The mortise member of the mortise plate is disposed between one of the pair of side-planks and the front-plank coupled thereto. The hook member extends adjacent to the front-plank. The mortise member is fixedly secured to both the side-plank and the front-plank with a first group of fasteners. The hook member is fixedly attached to the front-plank with a second group of fasteners.

BEST MODE FOR CARRYING OUT THE INVENTION

Figure 1:
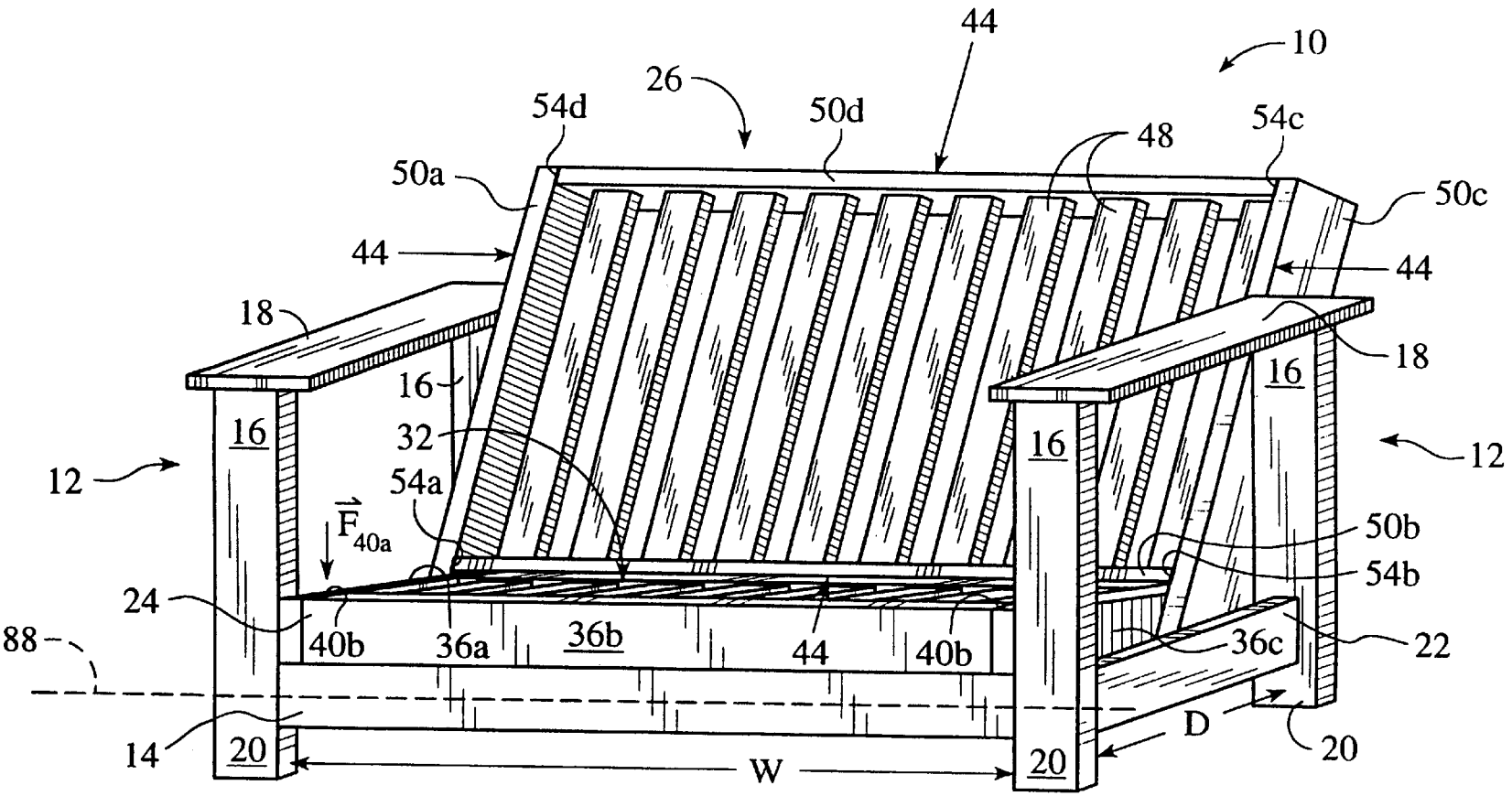
FIG. 1 is a perspective view of a bi-fold futon frame in accord with the present invention.
Figure 2:
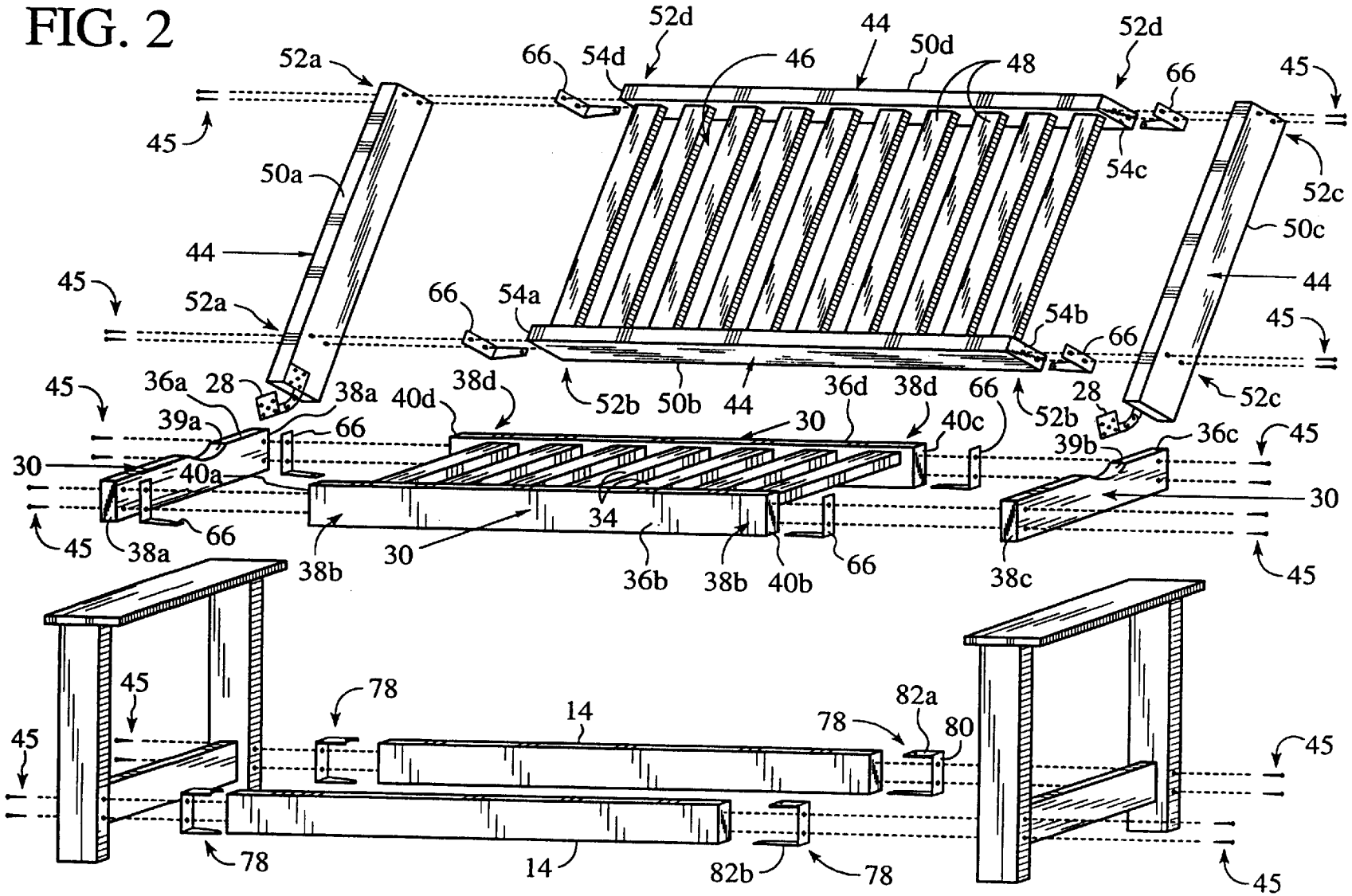
FIG. 2 is a an exploded perspective view of the bi-fold futon frame shown in FIG. 1.
Figure 3:
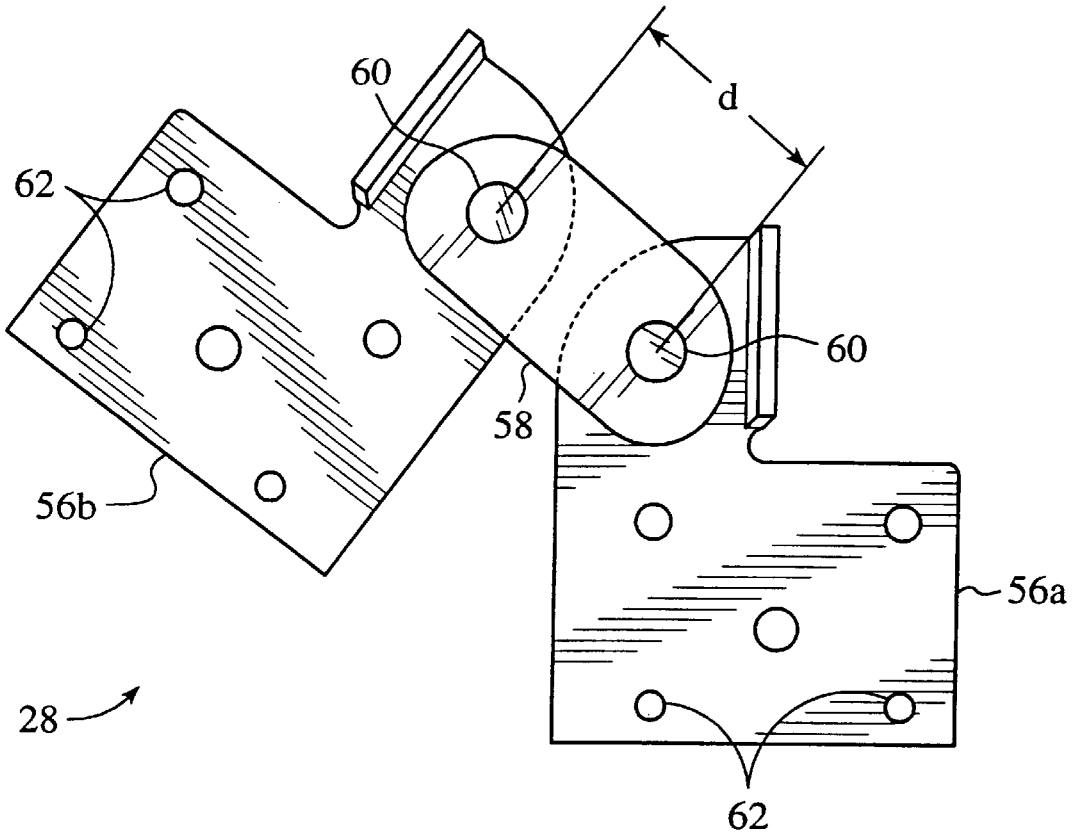
FIG. 3 is a plan view of a hinge shown in FIG. 1.
Figure 4:
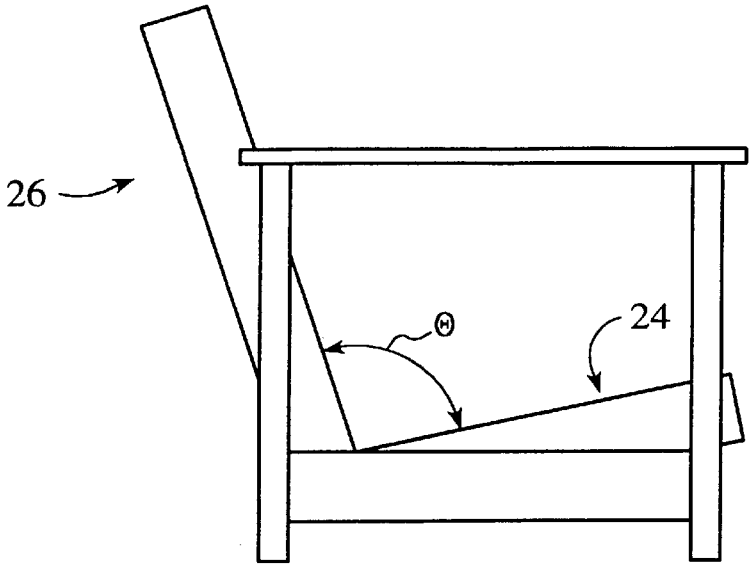
FIG. 4 is a plan view in which seat and folding platforms, shown in FIG. 1, are placed in an intermediate position to allow the futon frame to function as a sofa.
Figure 5:
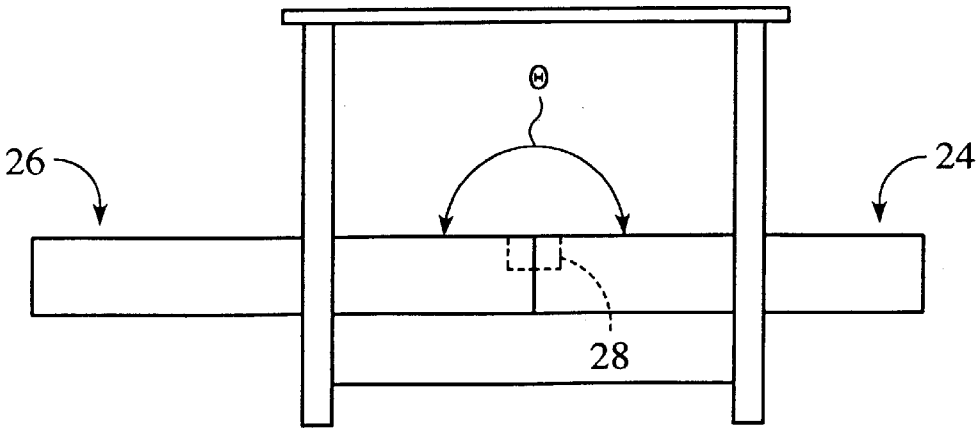
FIG. 5 is a plan view in which seat and folding platforms, shown in FIG. 1, are placed in an extended position to allow the futon frame to function as a bed.

Referring to FIGS. 1 and 2, a futon frame 10 includes a pair spaced-apart end frames 12 and a pair of spaced-apart and parallel cross-members 14 extending along a width-wise direction, W, between the ends frames 12. Each end frame 12 includes a pair of legs 16 that extends from an arm-rest 18, terminating in a foot-member 20. The legs 16 of each end frame 12 are spaced apart along a depth-wise direction, D, with the depth-wise direction, D, extending transverse to the width-wise direction, W. A support beam 22 is associated with each end frame 12 and extends between the legs 16, parallel to the depth-wise direction, D. A seat platform 24 is pivotally coupled to a back platform 26 via a hinge 28, shown more clearly in FIG. 2.

The seat platform 24 includes a plurality of billets, the ends of which are coupled together, forming a boundary 30 enclosing a region 32, and a plurality of slats 34. Although the boundary 30 may be of any shape desired, it is preferred that boundary 30 have a rectangular region. To that end, the seat platform 24 includes four billets 36*a*, 36*b*, 36*c* and 36*d*, each of which includes opposed tip portions 38*a*, 38*b*, 38*c* and 38*d*, respectively. Billets 36*a* and 36*c* are spaced-apart and extend parallel to each other, with billets 36*b* and 36*d* extending transverse thereto. Billets 36*b* and 36*d* are spaced-apart and extend parallel to each other. The slats 34 extend between billets 36*b* and 36*d*. In this fashion, one of the opposed tip portions 38*a* of billet 36*a* is attached, using fasteners 45, to a tip portion 38*b* of billet 36*b*, defining a union 40*a*. Although any type of fasteners may be employed, typically, fasteners 45 are wood screws. The remaining tip portion 38*a* of billet 36*a* is attached, using fasteners 45, to a tip portion 38*d* of billet 36*d*, defining a union 40*d*. The tip portion 38*b*, disposed opposite to billet 36*a*, is attached, using fasteners 45, to one of the opposed tip portions 38*c* of billet 36*c*, defining a union 40*b*. The remaining tip portion 38*c* of billet 36*c* is attached, using fasteners 45, to one of the opposed tip portions 38*d*, disposed opposite to billet 36*a*, of billet 36*d*, defining a union 40*c*.

The back platform 26 includes a plurality of planks, which are attached together in a fashion similar to the billets of the seat platform 24, discussed above. Specifically, the ends of the planks are coupled together, forming a perimeter 44 enclosing an area 46, and a plurality of panel-boards 48. Although the area 46 may be of any shape desired, it is preferred that area 46 have a rectangular shape. To that end, the seat platform 24 includes four planks 50*a*, 50*b*, 50*c* and 50*d*, each of which includes opposed tip portions 52*a*, 52*b*, 52*c* and 52*d*, respectively. Planks 50*a* and 50*c* are spaced-apart and extend parallel to each other, with planks 50*b* and 50*d* extending transverse thereto. Plank 50*b* and 50*d* are spaced-apart and extend parallel to each other, with the panel-boards 48 extending therebetween. In this fashion, one of the opposed tip portions 52*a* of plank 50*a* is attached, using fasteners 45, to a tip portion 52*b* of plank 50*b*, defining a junction 54*a*. The remaining tip portion 52*a* of plank 50*a* is attached, using fasteners 45, to a tip portion 52*d* of plank 50*d*, defining a junction 54*d*. The tip portion 52*b*, disposed opposite to plank 50*a*, is attached, using fasteners 45, to one of the opposed tip portions 52*c* of plank 50*c*, defining a junction 54*b*. The remaining tip portion 52*c* of plank 50*c* is attached, using fasteners 45, to one of the opposed tip portions 52*d*, disposed opposite to plank 50*a*, of plank 50*d*, defining a junction 54*c*.

Referring to FIGS. 1, 2, 3 and 4, as discussed above, the seat platform 24 is pivotally coupled to a back platform 26 via the hinge 28. The hinge 28 is adapted to allow the futon frame to extend between open and closed positions. In the fully open position, seat and back platforms 24 and 26 lie in a common plane, with the angle therebetween, θ, measuring 180°. The back platform 26 rests against one of the pair of cross-members 14, and the seat platform 24 lies against the remaining cross-member 14. Typically, the hinge 28 includes a pair of coupling plates 56*a* and 56*b* and a cam 58. Opposed ends of the cam 58 are pivotally connected to one of the coupling plates 56*a* and 56*b* via a brad 60, a pin or other type of member that functions as an axle. In this fashion, the coupling plate 56*a* is pivotally attached to coupling plate 56*b*. Each coupling plate includes a plurality of apertures 62 through which fasteners 45 pass to attach the hinge 28 to the futon 10. One of the pair of coupling plates 56*a* and 56*b* is attached to the seat platform 24, with the remaining coupling plate being attached to the back platform 26.

The distance, d, between the brads 60 is chosen to allow the back platform 26 to be superimposed over the seat platform 24 when placed in a closed position, with θ measuring 0°. This arrangement facilitates the transportation of the futon 10, as well as assembly of the same by an end user so that the seat and back platforms 24 and 26 may be shipped fully assembled, while minimizing the spaced needed for transportation of the same. Specifically, the volume occupied by the back and seat platforms 24 and 26 is minimized by having the two platforms superimposed adjacent to one another. Assembly by an end user is greatly eased by allowing the seat and back platforms 24 and 26 to be shipped fully-assembled and coupled together. To further facilitate shipping of the futon 10, one or more recesses 39*a* and 39*b*, may be formed in billets 36*a* and 36*c*, respectively, so as to be disposed opposite one another, shown more clearly in FIG. 2. The recesses 39*a* and 39*b* are adapted to retain one or more of the cross-members 14 when θ measures 0°.

The futon frame 10 is typically transported as part of a larger shipment of futon frames. This often results in several futon frames being placed in a stack. A futon frame located near the bottom of a stack may be subjected to a load of several thousand pounds. To provide resistance to this load, it is preferred that the billets 36*b* and 36*d* extend coextensive with planks 50*b* and 50*d* so that billets 36*a* and 36*c* rest against planks 50*a* and 50*c*, when the θ measures 0°, i.e., when the futon frame 10 is in the closed position. This provides added strength to both the seat and back platforms 24 and 26 and reduces the probability of failure during shipment.

A problem encountered with the futon frame, however, concerned cracks and splits which manifested in the wooden billets 36*a*, 36*b*, 36*c* and 36*d* and wooden planks 50*a*, 50*b*, 50*c* and 50*d*. These defects were found to have occurred during shipment and after repeated use of the futon frame 10. It was believed that the defects which occurred during shipment were a result of the location of the futon frame 10 among a stack of futon frames, i.e., the defective futon frame would be one which was located near a bottom of a stack. It was discovered, however, that the aforementioned defects resulted from the relatively small coupling area of the fasteners 45, producing a high force per unit area proximate to unions 40*a*, 40*b*, 40*c* and 40*d* and junctions 54*a*, 54*b*, 54*c* and 54*d*. To overcome this problem, a force spreading mortise plate 66, shown more clearly in FIG. 6, is positioned at each union 40*a*, 40*b*, 40*c* and 40*d* and junction 54*a*, 54*b*, 54*c* and 54*d*.

Figure 6:
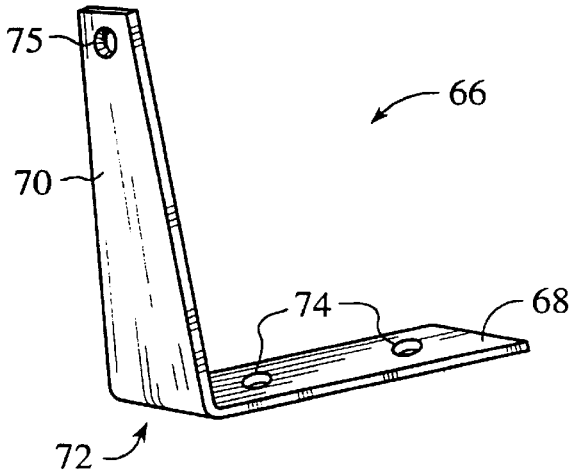
FIG. 6 is a perspective view of a force spreading mortise plate attached shown in FIG. 2.
Figure 7:
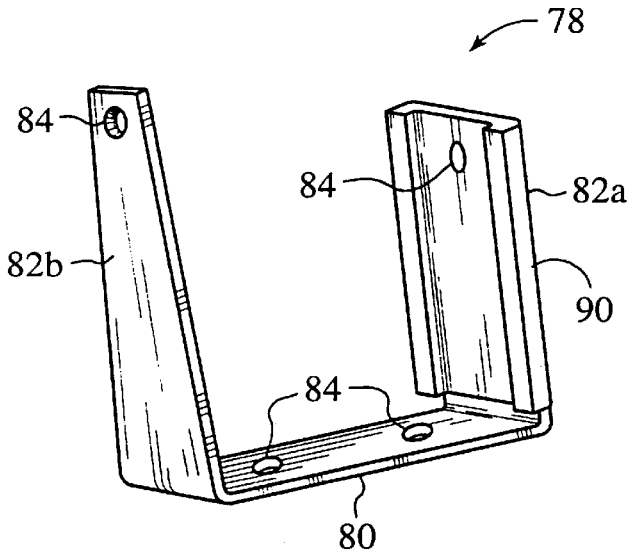
FIG. 7 is a perspective view of a U-shaped mortise plate shown in FIG. 2.
Figure 8:
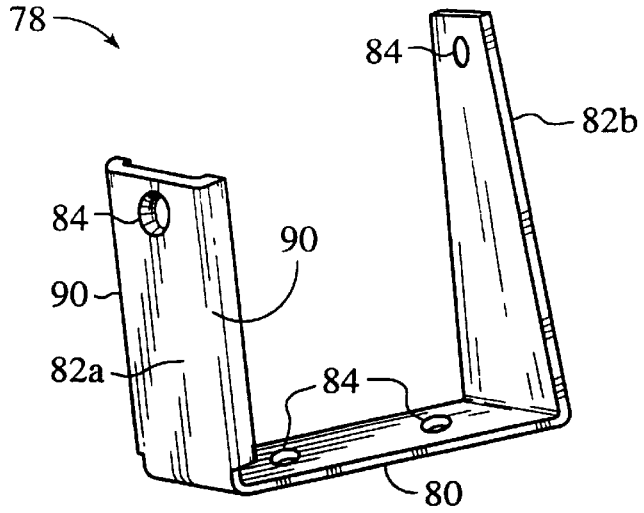
FIG. 8 is a perspective view of the U-shaped mortise plate shown in FIG. 4, rotated 180°.

As seen in FIG. 6, the mortise plate 66 includes a mortise member 68 and a hook member 70, extending transverse to the mortise member 68 and integrally formed therewith. A curved portion 72 is located between the mortise and hook members 68 and 70. Each of the mortise member 68 and the hook member 70 includes apertures 74 and 75, respectively. The mounting of each mortise plate 66 will be discussed with respect to unions 40*a* and 40*b*, but applies also to unions 40*c* and 40*d* as well as junctions 54*a*, 54*b*, 54*c* and 54*d*. As shown, the mortise member 68, associated with union 40*a*, is disposed between tip portions 38*a* and 38*b* of billets 36*a* and 36*b*, respectively. The mortise member 66 is fixedly attached to both billets 36*a* and 36*b* using a plurality of fasteners 45, which thread through tip portion 38*a* and into tip portion 38*b*, while passing through apertures 74. The hook member 70 extends adjacent to billet 36*b*, toward billet 36*c*, with fasteners passing through apertures 75. The mortise member 66, associated with union 40*b*, is disposed between tip portions 38*b* and 38*c* of billets 36*b* and 36*c*, respectively. The hook member 70 extends adjacent to billet 36*b*, toward billet 36*a* with both the mortise member 68 and hook member 70 fixedly attached as discussed above with respect to union 40*a*.

During shipment, a downward force would be exerted upon both the seat and back portions 24 and 26 which is imparted upon unions 40*a* 40*b* 40*c* and 40*d*, as well as junctions 54*a*, 54*b*, 54*c* and 54*d*. With respect to union 40*a*, the force imparted thereon is shown as $F_{40a}$. Instead of force $F_{40a}$ being focused over the relatively small area of the fasteners 45 and the surrounding portions of billets 36*a* and 36*b*, the force is spread over a larger area by the mortise plate 66. Specifically, force $F_{40a}$ is spread over the area of billet 36*b* resting against the hook member 70 as well as the fasteners 45. In addition, the forces $F_{40a}$ to which each of the fasteners are subjected is further spread over a larger area of tip portions 38*a* and 38*b* by the mortise member 68, thus, substantially reducing the force per unit area to which the union 40*a* is subjected. This greatly reduces the number of failures that occur during transportation of the futon 10. Moreover, the same principles provide the futon 10 with a longer operational life. Although the foregoing has been discussed with respect to union 40*a*, it should be understood that it applies with equal weight to unions 40*b* 40*c* and 40*d*, as well as junctions 54*a*, 54*b*, 54*c* and 54*d*.

It is preferred that the hook members 70 of the mortise plates 66 associated with the seat platform 24 extend adjacent to a side of billets 36*b* and 36*d*, facing cross members 14. In this fashion, the hook members 70 would not be sensed by a person seated thereupon. Also, with this configuration the hook members 70 would not damage a cushion placed upon the seat portion 24. However, the hook members 70 of the mortise plates 66 associated with the back platform 26 extend adjacent to a side of planks 50*b* and 50*d* facing away from cross members 14 and seat platform 24, providing similar benefits.

Referring to FIGS. 1, 2, 7 and 8, U-shaped mortise plates 78 are disposed at opposite ends of each of the pair of cross-members 14 to provide added durability to the futon 10. Each U-shaped mortise plate 78 has a mortise section 80, the opposed ends of which each terminates in hook sections 82*a* and 82*b*. The hook section 82*a* is disposed opposite to hook section 82*b* and extends parallel thereto. At least one hole 84 is included in the mortise section 80, the hook member 82*a* and the hook member 82*b*. Each U-shaped mortise plate 78 is disposed on the futon 10 so that the mortise section 80 is positioned between one of the cross-members 14 and one of the legs 16. The mortise section 80 is fixedly attached to the futon frame 10 with fasteners 45 threading through the leg 16 and into the cross-member 14, passing through one of the holes 84. In this configuration, each of the hook members 82*a* and 82*b* extend adjacent to opposing sides of the cross-member 14 and are fixedly attached thereto via fasteners 45.

To provide added durability, hook member 82*a* is designed to cover the entire width, measured transverse to a longitudinal axis 88 of the cross-member 14, on the side of the cross-member 14 which faces seat platform 24. The hook member 82*a* includes rounded edges 90, located at opposite ends of the width, to protect the edges of the cross-member 14, as well. In this fashion, the wear resulting from the friction of seat platform 24 sliding against the cross-member 14 is reduced. Specifically, the angular position of the back platform 26 is established by the positional relationship between the front cross-member 14*a* and the seat platform 24. The greater portion of the of the seat platform 24 that extends beyond cross-member 14*a*, opposite to cross-member 14*b*, the greater the angle θ between the back platform 26 and the seat platform 24. To control the positional relationship between the seat platform and the front cross-member 14*a*, a plurality of detents (not shown) are fitted onto the seat platform 24 so as to face the cross-member 14*a* and form an interference fit therewith. The detents are spaced-apart a sufficient distance to allow the cross-member 14*a* to fit between them.

Figure 9:
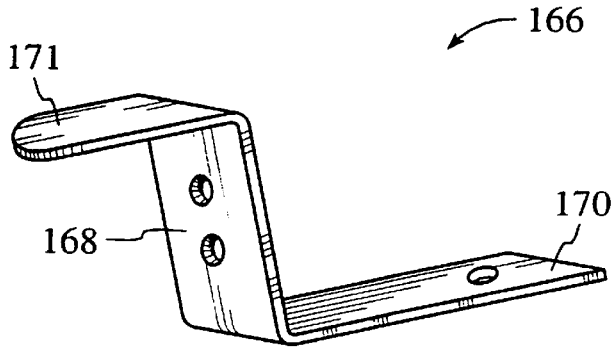
FIG. 9 is a perspective view of an alternate embodiment of the force spreading mortise plate shown in FIG. 6.
Figure 10:
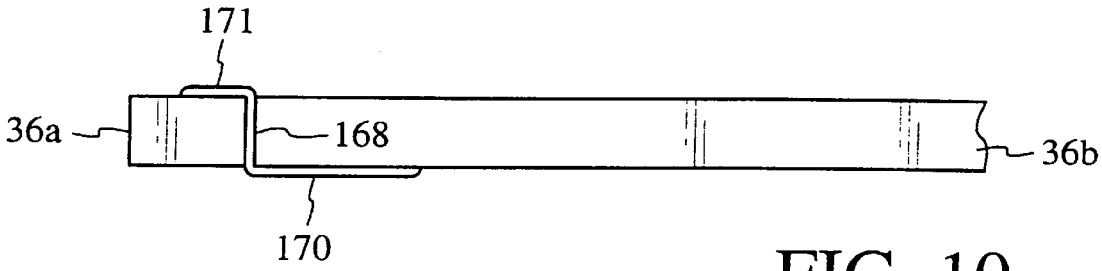
FIG. 10 is a plan view showing the coupling of the force spreading mortise plate shown in FIG. 9 to the futon frame shown in FIGS. 1 and 2.

In an alternate embodiment, the mortise plate 66 may be S-shaped, shown as 166 in FIG. 9. To that end, the hook member 170 extends from one end of the mortise member 168. From the opposite end of the mortise member 168, a detent 171 extends in a direction away from the hook member 170. In the seat platform 24 the detent 171 rests against one edge of the billets 36*a* or 36*c* with the hook member 170 extending adjacent to one of the edges of the billets 36*b* or 36*d*, shown in FIG. 10. In a similar manner the mortise plate 166 may be attached to the back platform 26.

Figure 12:
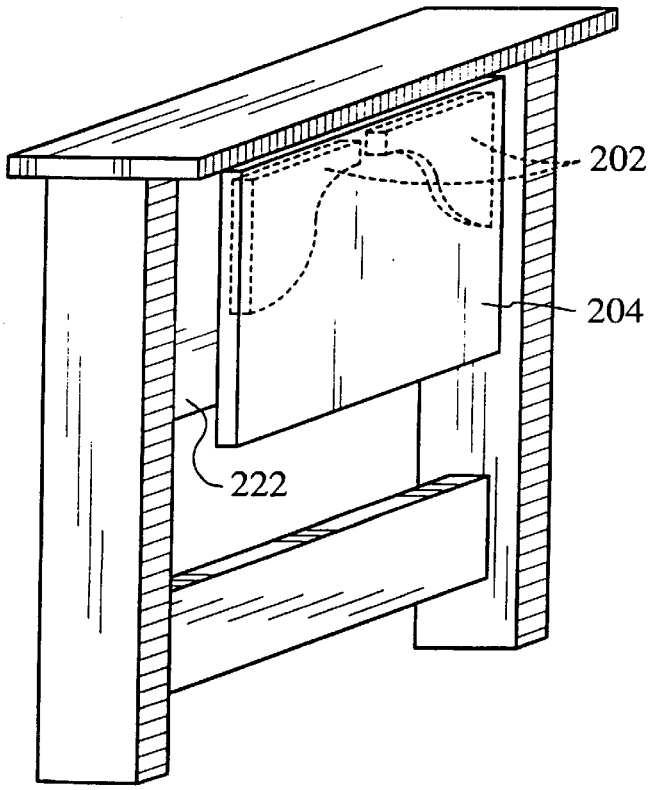
FIG. 12 is a plan view of the tray assembly shown in FIG. 11 in an retracted position.
Figure 11:
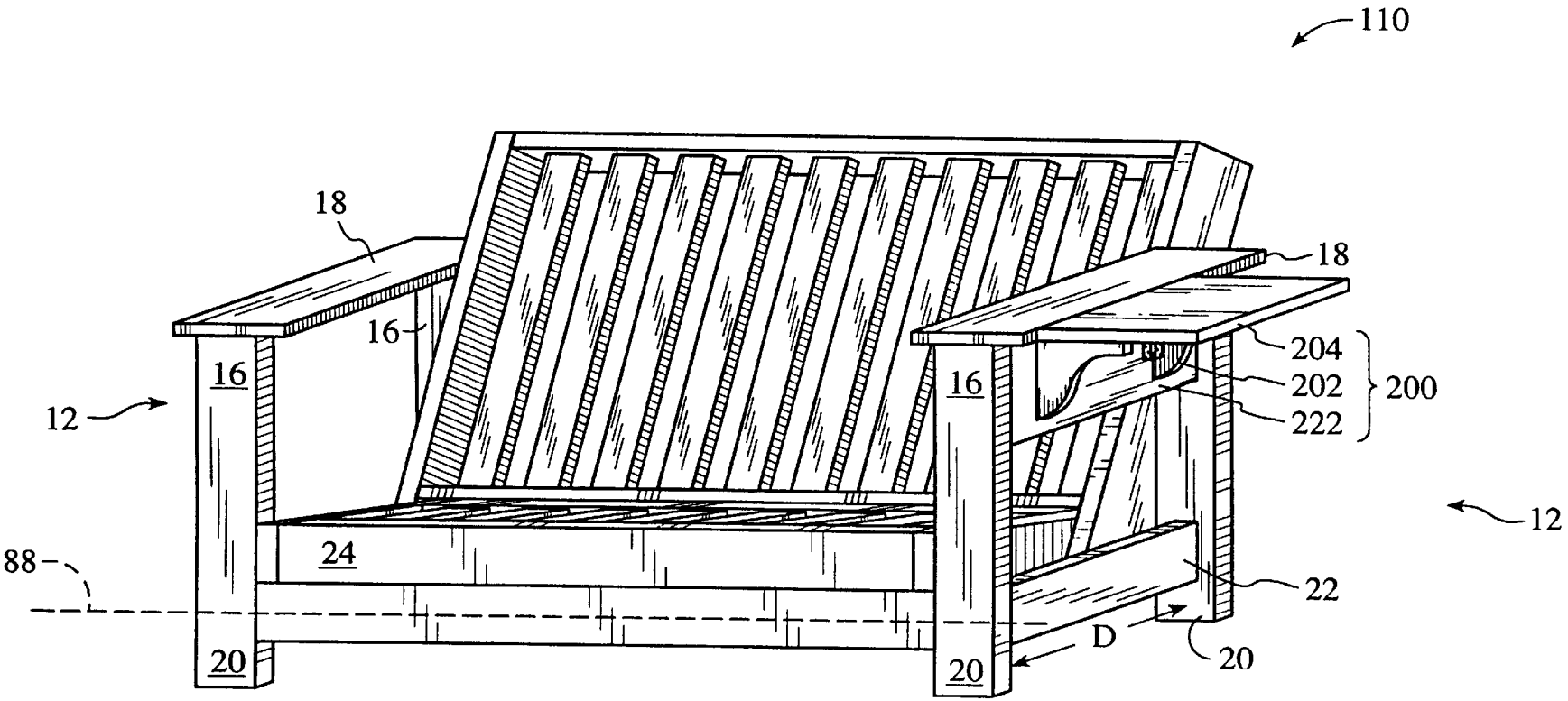
FIG. 11 is a perspective view of the futon frame shown in FIG. 1 including a tray assembly.

Referring to FIG. 11, in yet another embodiment of the futon 110 a folding tray system 200 may be attached to one or both of the end frames 12. The folding tray system 200 includes a second support beam 222 positioned between the arm-rest 18 and the support beam 22, which extends parallel thereto. A pair of spaced-apart support brackets 202 are pivotally attached to opposite ends of the second support beam 222 and a table 204 is pivotally attached to the arm-rest 18. The aforementioned pivotal attachments may be accomplished using any suitable hinge known in the art. Each of the brackets 202 are attached so as to pivot between retracted and extended positions. In the retracted position each bracket 222 is positioned against the second support beam 222, and the table 204 rests against the support brackets 202, shown more clearly in FIG. 12. In the extended position, each bracket 202 extends outwardly from the second support beam 222, away from the seat portion 24, with the table resting atop the brackets 204, shown more clearly in FIG. 11.

What is claimed is:

1. A futon, comprising:

a frame having a pair of spaced-apart legs;

a first platform resting against said frame;

a second platform coupled to said first platform, said second platform having a plurality of planks and a panel-board, with an end of each of said plurality of planks being coupled to one of the remaining planks of said plurality of planks, forming a plurality of junctions, said plurality of planks defining a perimeter enclosing an area that lies in a first plane against which a force is directed transversly to said first plane, with said panel-board extending across said area between opposed regions of said perimeter;

a force spreading mortise plate positioned at one of said plurality of junctions, said mortise plate having a mortise member and a hook member, with said hook member lying in a second plane orientated to extend transversely to both said force and said mortise member, and said mortise member being disposed between said end and the remaining plank and said hook member extending adjacent to the remaining plank; and a plurality of fasteners, a first group of said plurality of fasteners extending between said end and the remaining plank so as to pass through said mortise member and a second group of said plurality of fasteners passing through said hook member, wherein forces exerted upon said plurality of fasteners and said mortise plate are distributed between both said mortise member and said hook member, thereby reducing the force per unit area exerted upon said junction.

2. The futon as recited in claim 1 wherein said plate includes a plurality of pass-through having a smooth interior surface mortise plates, each of which is disposed at one of said plurality of junctions.

3. The futon as recited in claim 1 further including a hinge coupled between said first platform and said second platform, said hinge adapted to allow said second platform to extend between open and closed positions.

4. The futon as recited in claim 1 further including a tray assembly including a table pivotally attached to said frame to extend between extended and retracted positions.

5. The futon as recited in claim 1 further including a cross-member, having opposed terminations, extending between said legs and a pair of U-shaped mortise plates, each of which positioned proximate to one of said opposed terminations, each U-shaped mortise plate having a mortise section and a pair of spaced-apart and parallel hook sections extending from opposite sides of said mortise section, with the mortise section of each U-shaped plate being disposed between one of said terminations and one of said legs and fixedly attached therebetween, and said hook sections fixedly attached, and extending adjacent, to said cross-member.

6. The futon as recited in claim 3 further including a pair of spaced-apart and parallel cross-members extending between said legs, with said second and first platforms lying in a common plane in said open position so that said second platform lies against one of said pair of cross-members and said first platform lies against the remaining cross-member.

7. The futon as recited in claim 3 wherein said first platform includes a plurality of billets and a slat, with a tip portion of each of said plurality of billets being coupled to one of the remaining billets of said plurality of billets, forming a plurality of unions, with said plurality of billets defining a boundary enclosing an region, with said slat extending across said region between opposed portions of said boundary.

8. The futon as recited in claim 7 further including first and second groups of mortise plates, with reach of the mortise members of said first group being disposed between a pair of said plurality of planks and each of the hook members of said first group plate extending adjacent to one of said pair of planks, with each of the mortise members of said second group being disposed between a pair of said billets and each of the hook members of said second mortise plate extending adjacent to one of said pair of billets, said plurality of fasteners including third and fourth groups, with fasteners of said fourth group extending between said tip portion and the remaining billet so as to pass through the mortise members of said second group and the fasteners of said fourth group passing through the hook members of said second group.

9. The futon as recited in claim 8 wherein an edge of said perimeter rests against a surface of said boundary upon said second platform being placed in said closed position, with the hook members associated with mortise plates of said first group being positioned to extend adjacent to said planks opposite to said edge and the hook members of the mortise plates of said second group extending adjacent to said billet opposite to said surface.

10. A futon, comprising:

a frame having a pair of spaced-apart legs;

a first platform having a plurality of billets and a slat, with an end of each of said plurality of billets being coupled to one of the remaining billets of said plurality of billets, forming a plurality of unions, with said plurality of billets defining a boundary enclosing a region, with said slat extending across said region between opposed regions of said boundary;

a second platform pivotally coupled to said first platform, said second platform having a plurality of planks and a panel-board, with a terminus of each of said plurality of planks being coupled to one of the remaining planks of said plurality of planks, forming a plurality of junctions, said plurality of planks defining a perimeter enclosing an area that lies in a first plane against which a force is directed transversly to said first plane, with said panel-board extending across said area between opposed regions of said perimeter; and first and second mortise plates, each of which includes a mortise member and a hook member, with said hook member lying in a second plane orientated to extend transversely to both said force and said mortise member, and said mortise member of said first mortise plate being disposed between said end and the remaining plank, said hook member of said first mortise plate extending adjacent to the remaining plank, said mortise member of said second mortise plate being disposed between said union and the remaining billet and the hook member of said second mortise plate being extending adjacent to said the remaining billet, wherein forces exerted upon said plurality of junctions and unions are distributed between both said mortise member and said hook member associated therewith, thereby reducing the force per unit area exerted upon said frame.

11. The futon as recited in claim 10 further including a hinge coupled between said first platform and said second platform, said hinge adapted to allow said second platform to extend between open and closed positions.

12. The futon as recited in claim 11 wherein relative dimensions of said second and first platforms are established to facilitate resting two of said plurality of billets against two of said plurality of planks in said closed position.

13. The futon as recited in claim 11 further including first and second groups of mortise plates, with the hook members associated with mortise plates of said first group extending adjacent to a side of said remaining billets located opposite to said first platform and the hook members of the mortise plates of said second group extending adjacent to an edge of said remaining planks located opposite to said side, when said second platform is in said closed position.

14. The futon as recited in claim 11 further including a pair of spaced-apart and parallel cross-members, each having opposed terminations, with said pair of cross-members extending between said legs, said second and first platforms lying in a common plane in said open position so that said second platform lies against one of said pair of cross-members and said first platform lies against the remaining cross-member.

15. The futon as recited in claim 14 further including a plurality of U-shaped mortise plates, each of which positioned proximate to one of said opposed terminations, each U-shaped mortise plate having a mortise section and a pair of spaced-apart and parallel hook sections extending from opposite sides of said mortise section, with the mortise section of each U-shaped plate disposed between one of said terminations and one of said legs and fixedly thereto, and said hook sections fixedly attached and extending adjacent to said cross-member.

16. A futon, comprising:

a frame having a pair of spaced-apart legs;

a pair of spaced-apart and parallel cross-members extending between said pair of legs;

a first platform attached to said frame;

a second platform coupled to said first platform, with said second and first platforms each including a pair of spaced-apart and parallel side-planks, a pair of spaced-apart and parallel slats and a panel-board extending between said pair of slats, with said pair of slats extending from opposite ends of one of said parallel side-planks, transversely thereto, terminating at opposite ends of the remaining side-plank of said pair of said-planks, wherein a plurality of junctions are formed between said pair of side planks and said pair of slats, with said plurality of junctions lying in a first plane against which a force is directed transversly to said first plane;

a mortise plate positioned at one of said plurality of junctions, said mortise plate having a mortise member and a hook member, with said hook member lying in a second plane orientated to extend transversely to both said force and said mortise member, and said mortise member being disposed between one of said pair of side-planks and said hook member extending adjacent to one of said pair of slats; and a plurality of fasteners, with each of said plurality of junctions having a fastener extending through one of said pair of slats and one of said pair of side-planks parallel to the longitudinal axis of the latter and perpendicular to the longitudinal axis of the former, with one of said plurality of fasteners extending through said mortise portion, wherein forces exerted upon both said one of said plurality of fasteners and said mortise pate are distributed between both said mortise member and said hook member, thereby reducing the force per unit area exerted upon said futon.

17. The futon as recited in claim 16 further including a hinge coupled between said first platform and said second platform, said hinge adapted to allow said second platform to extend between open and closed positions, with said second platform being superimposed over said first platform in said closed position.

18. The futon as recited in claim 17 wherein the slats associated with said first platform extend coextensive with, and parallel to, the slats associated with said second platform when in said closed position.

19. The futon as recited in claim 17 wherein said second and first platforms lie in a common plane in said open position so that said second platform lies against one of said pair of cross-members and said first platform lies against the remaining cross-member.

20. The futon as recited in claim 19 wherein each of said plurality of mortise pates includes a plurality of pass throughs having a smooth inner surface the side-planks associated with said seat platform rest against the side-planks associated with said back platform in said closed position.

* * * * *